United States Patent [19]

Gil

[11] Patent Number: 4,587,815

[45] Date of Patent: May 13, 1986

[54] NONROTATING, FLEXIBLE KEY LOCK

[76] Inventor: Eugenio S. Gil, Av. Francisco Solano López, Edf. Morichal, 40 Piso, Apto. 42, Sabana Grande - Caracas 1050, Venezuela

[21] Appl. No.: 595,223

[22] Filed: Mar. 30, 1984

[30] Foreign Application Priority Data

Dec. 12, 1983 [ES] Spain ..... 276.246

[51] Int. Cl.[4] ..... E05B 25/00

[52] U.S. Cl. ..... 70/352; 70/377; 70/392

[58] Field of Search ..... 70/348, 349, 350, 351, 70/352, 353, 354, 355, 376, 377, 392

[56] References Cited

U.S. PATENT DOCUMENTS

| | | | |
|---|---|---|---|
| 86,276 | 1/1869 | Brady . | |
| 89,852 | 5/1869 | Cilley . | |
| 982,863 | 1/1911 | Phillips | 70/352 |
| 1,355,725 | 10/1920 | Zimmermann . | |
| 2,070,619 | 2/1937 | Price | 70/353 |
| 3,452,166 | 6/1969 | Deakin . | |
| 3,505,841 | 4/1970 | Sinclair | 70/350 |
| 3,640,107 | 2/1972 | Litvin . | |
| 3,653,238 | 4/1972 | Brugemann . | |
| 3,654,783 | 4/1972 | Sinclair . | |
| 3,851,152 | 11/1974 | Nii . | |
| 3,885,132 | 5/1975 | Luoma . | |
| 4,007,615 | 2/1977 | Nossum . | |
| 4,287,737 | 9/1981 | Ahn . | |
| 4,388,815 | 6/1983 | Lawler . | |

*Primary Examiner*—Robert L. Wolfe

*Attorney, Agent, or Firm*—Seed and Berry

[57] ABSTRACT

A lock for use with a nonrotating, flexible sheet key having holes positioned according to a pattern. The lock has a plurality of plates independently slidable for movement along a path generally transverse to the key. Each plate has a pin at a selected location along an edge toward the key for engagement therewith. The pins are aligned according to the key hole pattern to have some of the pins enter into the holes and others contact the body upon movement of the plates toward the key for placing each plate in a consent position. Each plate has an aperture for coincidence with the apertures of the other plates when moved into their respective consent positions for forming a lateral opening. An arm extends through the apertures and is laterally movable within the lateral opening to indicate an unlocked condition. Several plates have a portion extending transverse to the lateral opening and positionable to limit the length of the lateral opening if not in the consent position and inhibit lateral movement of the arm to indicate a locked condition. The arm engages another plate portion to move the plates away from the key during its insertion.

19 Claims, 10 Drawing Figures

FIG. 1
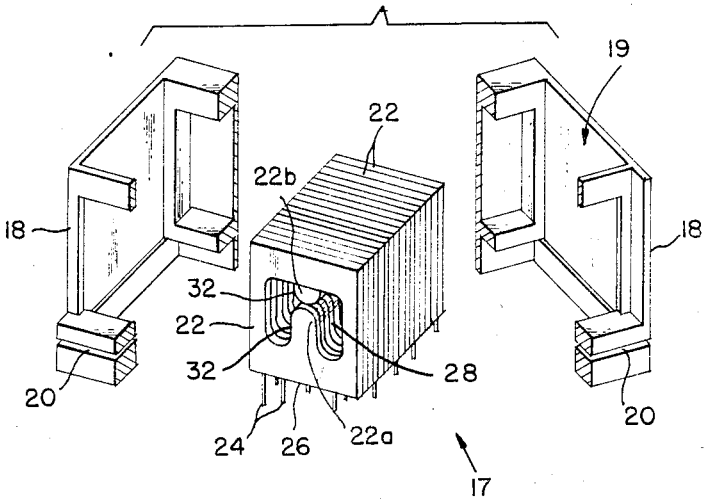
FIG. 2
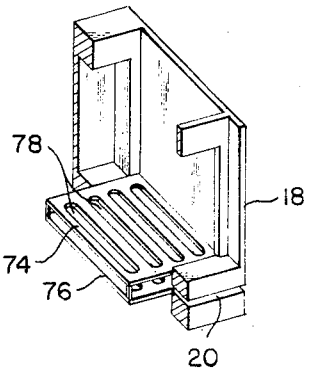
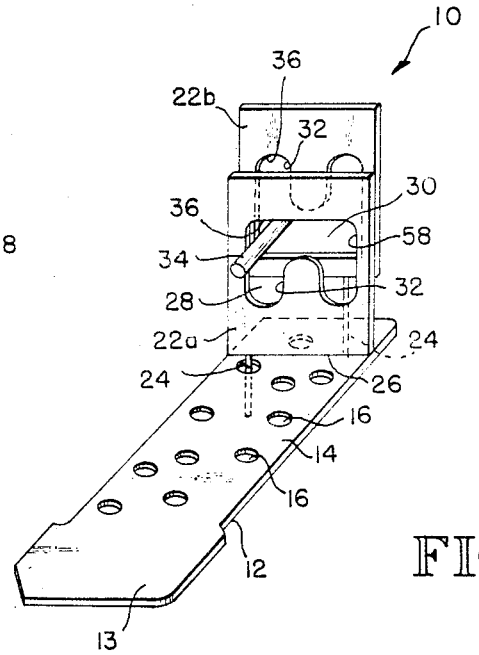
FIG. 3
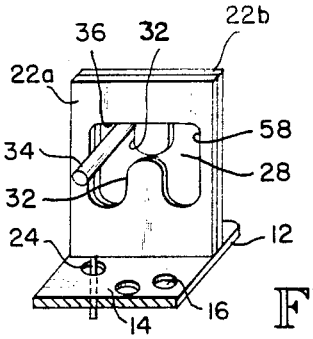
FIG. 3A

NONROTATING, FLEXIBLE KEY LOCK

DESCRIPTION

1. Technical Field

The present invention relates generally to locks, and more particularly, to locks utilizing a nonrotating, perforated, flat key.

2. Background Art

In the past, locks have used rotating keys with grooves thereon which engage a tumbler to operate the lock. Such lock and the keys therefor are expensive to make, and resetting the tumbler arrangement for operation with another key is difficult. Furthermore, such locks are often easy to pick or to unlock with a similar key.

To overcome these disadvantages, locks have been designed utilizing a nonrotating, perforated plate key. One such lock is disclosed in U.S. Pat. No. 4,287,737, which shows a lock in which a rigid plate key is inserted. The lock has a plurality of operating rods having checking protrusions on one end therof which slidably engage and move along the plate key as it is being inserted to check if any of several rows of perforations in the plate key correspond to a predetermined row pattern. If the row pattern is encountered, the apertures in the operating rods align in a manner which allows a control rod to pass transversely through the apertures and thereby release a bolt. The operating rods are disposed in a stacked configuration, oriented transverse to the direction of insertion of the plate key for successively checking rows of perforations as the plate key moves past the operating rods. The operating rods are spring biased toward the plate key and engage it with sufficient force to push the checking protrusions into the perforations as the plate key is slid thereby.

In such a lock, the plate key must, of necessity, be rigid so that it can be pushed into the lock to pass the rows of perforations by the checking protrusions, which are spring loaded against the plate key and in constant engagement therewith, thus causing a frictional drag on the key. It is, however, sometimes desirable to use a flexible or "soft" sheet key manufactured of paper, thin plastic, or a similarly flexible material. A paper sheet key has the advantage of being inexpensive to manufacture, light in weight, and foldable for convenient storage.

It will therefore be appreciated that there has been a significant need for a lock which operates with a nonrotating, perforated, flexible sheet key. The lock must not apply pressure to the sheet key as the key is being inserted into the lock, and preferably provides an increased number of possible perforation patterns to decrease the likelihood that an unauthorized person can quickly try a number of combinations and learn the proper pattern for unlocking the lock. It is also desirable that no force be transmitted to the sheet key when turning a rotatable handle which actuates the lock mechanism, even when the sheet key does not have the proper perforation pattern. In addition, the lock should have a design in which the perforation pattern which opens the lock may be easily and quickly changed, and a design which requires minimum precision in the manufacture and assembly of its parts, while still achieving proper lock operation. The present invention fulfills these needs and further provides other related advantages.

DISCLOSURE OF INVENTION

The present invention resides in a lock for use with a nonrotating, flexible sheet key having a body with a plurality of holes therethrough positioned in accordance with a predetermined pattern. The lock has a case with a slot for insertion of the key therethrough to place the key body in a stationary position within the case. A plurality of juxtapositioned plates are disposed within the case in independently slidable, face-to-face relative relation to each other for movement along a path generally transverse to the key. The plates each have a pin fixedly positioned at a selected location along an edge of the plate toward the key for engagement therewith. The pins are aligned according to the predetermined hole pattern to have selected ones of the pins enter into the holes and other ones of the pins contact the body upon movement of the plates along the path towards the key for placing each of the plates in a consent position. The plates each have an aperture therethrough sized and positioned for coincidence with the apertures of the other plates when moved into their respective consent positions to form an elongated lateral opening. At least one of the plates has a body portion extending transverse to the lateral opening and being positionable to block and limit the length of the lateral opening if the plate with the transverse body portion is not in its consent position as a result of insertion of a key without the predetermined hole pattern. The plates are positionable away from the key to maintain the pins disengaged from the key for unrestricted insertion of the key into the slot and are movable toward the key for engagement therewith after the key is inserted into the slot. The lock further includes a lug or arm extending generally transversely through the plate apertures and being laterally movable within the lateral opening formed when the plates are in their consent position to indicate an unlocked condition. Lateral movement of the lug is inhibited by the transverse body portion of the plate not in its consent position to indicate a locked condition.

Each of the plates also has a second body portion defining the aperture and located to a side of the aperture away from the key. The lug is engageable with the second body portion of each of the plates and movable in a direction away from the key to hold the pins clear of the key to permit unrestricted insertion of the key into the slot. The lug is further movable in a direction toward the key to permit the pins to engage the key. The lug is attached to a movable member having a cam follower operatively engaging a rotatable cam. The cam has a first portion initially positioning the lug away from the key in engagement with the second body portion of the plates to hold the pins clear of the key for insertion of the key into the slot. The cam has a second portion next moving the lug toward the key upon rotation of the cam to permit the plates to move freely along the path toward the key to bring the pins into engagement therewith. The cam has a third portion next moving the lug laterally in the lateral opening upon further rotation of the cam when the plates are in the consent position. The third cam portion also permits continued rotation of the cam without moving the lug laterally when the plate with the transverse body portion is not in its consent position.

In a presently preferred embodiment of the invention, the plates are oriented vertically, with the pins extending downwardly toward the key positionable therebelow. The plates are movable downward along the path towards the key by the gravitational force on the plates. In another embodiment, biasing means are included for resiliently biasing the plates towards the key. The biasing means includes a spring independently biasing each of the plates. In one embodiment of the invention, the pins are substantially flat, elongated members.

The movable member has a guide pin slidably and rotatably disposed in a laterally extending guide slot. The guide pin is initially positioned toward one end of the guide slot, and the guide slot is sized to permit lateral sliding movement of the guide pin therein in response to the third cam portion upon rotation of the cam to move the lug laterally in the lateral opening. The guide pin permits rotational movement of the movable member thereabout as the cam rotates. The cam follower is resiliently biased against the cam.

The lock further includes a pair of spaced-apart guide plates positioned within the case to receive the key therebetween from the slot and maintain the key in a flat condition during insertion and operation of the lock. The guide plates have a plurality of openings therein to permit uninhibited passage of the pins for engaging the key.

In one embodiment of the invention, the plates each have a second pin fixedly attached at a selected location along an edge of the plate away from the key and extending therefrom. The plates are selectively reversible in the case to position the plates for engagement of the second pin with the key. The case has means for selective removal and replacement of the plates.

Other features and advantages of the invention will be apparent from the following detailed description, taken in conjunction with the accompanying drawings.

BRIEF DESCRIPTION OF THE DRAWINGS

FIG. 1 is a perspective view of a key reader portion of a lock embodying the present invention, with a case containing keyed plates and shown split in half for purposes of illustration.

FIG. 2 is a sectional perspective view of the right half of the case of FIG. 1, shown with slotted guide plates.

FIG. 3 is an enlarged perspective view of two keyed plates of the lock of FIG. 1 engaging a flexible sheet key, with the plates shown in their respective consent positions.

FIG. 3A is a perspective view of the two keyed plates of FIG. 3 showing the rearmost plate not in the consent position, with lateral movement of a lug being prevented.

BEST MODE FOR CARRYING OUT THE INVENTION

Figure 4:
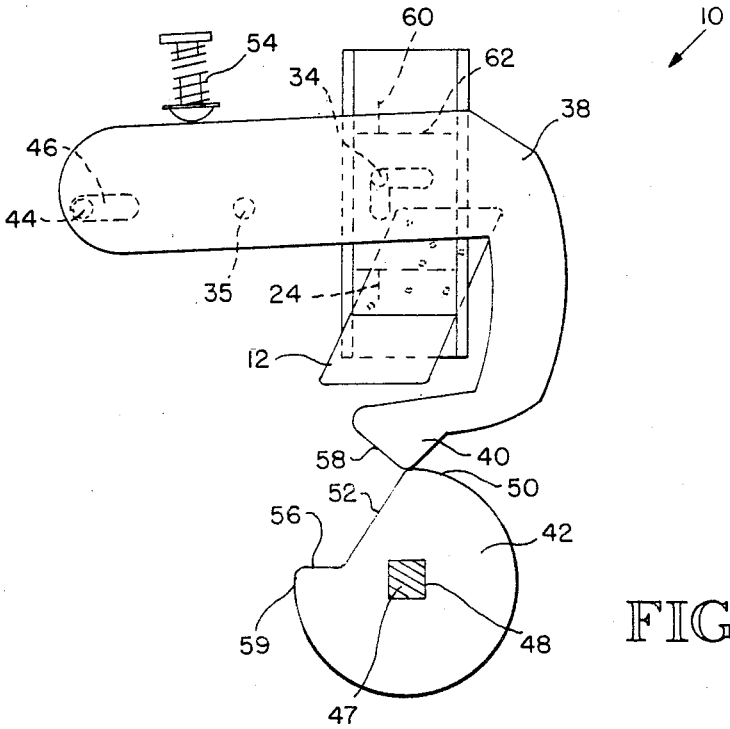
FIG. 4 is a front view of an alternative embodiment of the key reader of the lock of FIG. 1, showing the associated lock mechanism in its initial operating position in which the sheet key may be freely inserted.
Figure 5:
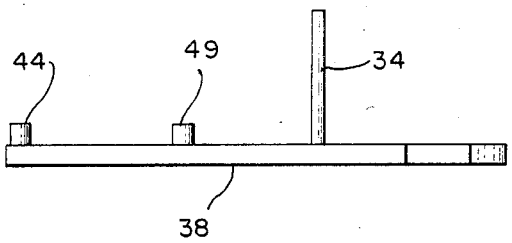
FIG. 5 is a top plan view of a carrier arm of the lock mechanism of FIG. 4.

As shown in the drawings for purposes of illustration, the present invention is embodied in a lock, indicated generally by reference numeral 10, of the type using a nonrotating, perforated key 12. The key 12 is a flexible paper sheet key having a handle portion 13 for grasping and a body portion 14 with a plurality holes 16 therethrough positioned in accordance with a predetermined hole pattern which may extend over nearly the entire length and width of the body portion. The key may also be manufactured of any other flexible sheet material, such as plastic. As best shown in FIG. 1, the lock 10 includes a key reader 17 comprised of a case 18, shown for purposes of illustration separated into left and right halves. The case 18 has a slot 20 therein sized for insertion of the key 12 therethrough to place the key body 14 in a stationary position within the case.

A plurality of juxtapositioned plates 22 are disposed within the case 18 in independently slidable, face-to-face relative relation to each other for movement along a path generally transverse to the key 12 when inserted. The case 18 has an open top 19 for placing the plates 22 within the case during assembly. Each of the plates 22 has a pin 24 fixedly attached thereto at a selected location along an edge 26 of the plate 22 closest to the key 12 and extending from the plate toward the key for engagement therewith. The pin 24 of each plate 22 is positioned along the edge 26 of the plate in accordance with the predetermined hole pattern. It is noted that since the pin may be located at any point along the edge 26 of the plate 22, a large number of possible pin position combinations are possible, even when a few plates are used, making detection of the predetermined hole pattern for the key 18 difficult for an unauthorized person to determine.

With the pins 24 of the plates 22 aligned according to the predetermined hole pattern, selective ones of the pins enter into the holes 16 and other ones of the pins contact the body portion 14 of the key 12 upon movement of the plates along their path towards the key. With a key 12 having the predetermined hole pattern inserted into the key reader 17 and the pins 24 in engagement with the key, the plates 22 are each placed in their respective consent position. The consent position for a particular plate 22 positions the plate at a predetermined distance from the key 12, depending upon whether the pin 24 of the plate enters one of the holes 16 or contacts the body portion 14, and, in the latter situation, the length of the pin.

Each of the plates 22 has an aperture 28 therethrough sized and positioned for coincidence with the aperture of each other of the plates when moved into their respective consent positions to form an elongated lateral opening 30. while the apertures 28 of the plates 22 may have various shapes, at least one or more of the plates has a first wall portion 32 extending generally transverse to the lateral opening 30 and positioned to block and limit the length of the lateral opening if the plate with the blocking wall portion is not in its consent position. Such results if a key without the predetermined hole pattern is inserted into the key reader 17.

The operation of the plates 22 is best illustrated in FIGS. 3 and 3A. In FIG. 3, two plates **22*a* and 22*b* are shown in their respective consent positions wherein the apertures 28 of each plate coincide to form the elongated lateral opening 30. in FIG. 3A**, the same two plates 22*a* and 22*b* are shown, with the plate 22*b* not being in its consent position, as a result of the pin 24 of the plate entering into a hole 16 in the key which is not in accordance with the predetermined hole pattern. With the plate 22*b* in the position shown in FIG. 3A, the first wall portion 32 blocks and limits the length of the lateral opening 30.

As will be described in more detail below, an arm or lug 34 extends transversely through the apertures 28 and is laterally movable within the lateral opening 30 formed when the plates are in their consent positions. The lug 34 is initially at a leftmost position in the lateral opening 30 and moves laterally to the right to indicate an unlocked condition. When rightward lateral movement of the lug 34 is inhibited by the transverse first wall portion 32 of any one of the plates 22 because it is not in a consent position, a locked condition is indicated. The lug 34 may be connected to any conventional lock linkage (not shown) to move a bolt or the like (not shown) in response to the lateral movement of the lug 34.

The plates 22 are movable within the case 18 to allow their positioning away from the key 12 to maintain the pins 24 disengaged from the key for unrestricted insertion of the key into the slot 20. After the key 12 is inserted into the slot 20, the plates 22 are movable within the case 18 toward the key for engagement of the pins 24 therewith. The plates 22 each have a second wall portion 36 defining a leftward portion of the aperture 28 and located to a side of the aperture away from the key 12. The lug 34 is engageable with the second wall portion 36 of each of the plates 22 and movable in a direction away from the key 12 to lift the plates and hold the pins 24 clear of the key during its insertion. The lug 34 is also movable in a direction toward the key 12 to permit the pins 24 to engage the key.

In the embodiment of the lock 10 shown in FIGS. 4–7, the lug 34 is fixedly attached to a carrier arm 38 having a cam follower 40 operatively engaging a rotatable cam 42. The carrier arm 38 is a flat, "J"-shaped plate with the cam follower 40 formed on the short arm of the "J." The carrier arm 38 has a guide pin 44 fixedly attached to the long arm of the "J," and the guide pin is slidably and rotatably disposed in a laterally extending guide slot 46. The rotatable cam 42 is connected to a door handle (not shown) by a shaft 47 having a squared center portion which is retained within a correspondingly shaped central opening 48 in the cam. The carrier arm 38 has a connector pin 49 for connection to a bolt or the like for its movement in response to lateral movement of the lug 34.

In operation, the cam follower 40 slidably engages and rides over the surface of the cam 42 as the door handle is rotated for operation of the lock 10. The lock 10 is shown in its initial position in FIG. 4, with a first cam portion 50 of the cam 42 holding the carrier arm 38 in a raised position. In this raised position, the lug 34 engages the second wall portion 36 of the plates 22 and lifts the plates 22 to hold their pins 24 clear of the key 12 to permit its unrestricted insertion into the slot 20. With the key 12 inserted into the slot 20, the user of the lock 10 rotates the door handle clockwise, and hence the cam 42, during which the cam follower 40 rides down a relatively gradual, inwardly sloped second portion 52 of the cam to lower the plates toward the key and bring the pins 24 into engagement with the key. The cam follower 40 is resiliently biased against the cam 42 by a spring 54 which bears against the carrier arm 38. It is noted that rightward movement of the carrier arm 38 is prevented by the first wall portions 32 of the plates 22 until the plates are lowered sufficiently for a key 12 having the predetermined hole pattern to place them in their respective consent positions.

Further clockwise rotation of the cam 42 brings a thrid portion 56 of the cam into contact with the cam follower 40. The third cam portion 56 has a relatively steep outward slope which generally corresponds in shape to a left face portion 58 of the cam follower 40. Clockwise rotation of the cam 42 brings the third cam portion 56 into sliding engagement with the left face portion 58 of the cam follower 40 and applies a rightward directed force thereto, tending to move the carrier member 38 and the lug 34 rightward.

If the key 12 has the predetermined hole pattern which places the plates 22 in their respective consent positions, the lug 34 is moved laterally rightward through the elongated lateral opening 30 formed by coincidence of the apertures 28. The operation of the third portion 56 of the cam 42 is shown sequentially in FIGS. 6 and 7. In FIG. 7, the carrier arm 38 is shown moved to its rightmost position. As previously described, the movement of the lug 34 from left to right may be used to unlock a bolt or the like to which the lock 10 of the present invention is connected.

With a key 12 inserted not having the predetermined hole pattern, at least one of the plates 22 will not assume its consent position and the blocking first wall portion 32 of the plate will inhibit the lateral rightward movement of the lug 34 and maintain the bolt or the like in a locked condition. To prevent damage to the lock 10 by the application of excessive force to the door handle in an attempt to continue its clockwise rotation after the lug 34 engages the first wall portion 32, the third cam portion 56 is shaped to allow the cam follower 40 to merely ride upward on the cam 42 and raise the carrier arm 38 if rotation is continued. In a similar fashion, the third cam portion 56 will allow the cam follower 40 to ride upward on the cam 42 after the carrier member 38 travels to its rightmost position and the lug 34 engages a third wall portion 58 defining a rightward portion of the aperture 28. In such manner, the tolerance of the aperture sizing and the physical arrangement of the cam 42 and carrier arm 38 relative thereto is not critical to operation of the lock 10.

If the cam 42 is turned sufficiently clockwise to cause the cam follower 40 to ride fully up the third cam portion 56, it reaches a fourth portion 59 of the cam 42, whereat the plates 22 are raised enough for the pins 24 to clear the key 12 and permit removal of the key from the slot 20, if desired. The cam 42 may be spring loaded to return the lock 10 to its initial position by the user releasing the door handle or may be designed to require the user to turn the cam 42 counterclockwise. In either case, the sequence of operation has the cam follower 40 riding down the third cam portion 56 to move the pins 24 of the plates 22 into engagement with the key 12, and then riding up the second cam portion 52 to lift the plates 22. If a key 12 with the predetermined hole pattern was used, the clockwise rotation of the cam 42 will have moved the carrier arm 38 to its rightmost position, as shown in FIG. 7. In such an instance, the counterclockwise rotation of the cam 42 will cause the second cam portion 52 to apply a leftward directed force on the cam follower 40 and return the carrier arm 38 to its initial leftmost position, shown in FIG. 4. Further counterclockwise rotation of the cam 42 brings the cam follower 40 to the first cam portion 50, at which point further counterclockwise rotation of the cam is prohibited by a stop (not shown), and the plates 22 are lifted with the pins 24 clear of the key 12, permitting its withdrawal from the slot 20.

With the guide arm 38 in the position shown in FIG. 4, the guide pin 44 is positioned toward the leftmost end of the guide slot 46. The guide slot 46 extends laterally to the right to permit the unrestricted lateral sliding movement of the guide pin 44 therein in response to the third cam portion 56 moving the guide arm 38 to the right upon clockwise rotation of the cam 42 when the plates 22 are in their respective consent positions. The guide pin 44 is permitted to rotate within the guide slot 46 to allow the cam follower 40 to ride along the cam 42 as the cam is rotated during operation of the lock 10.

Figure 6:
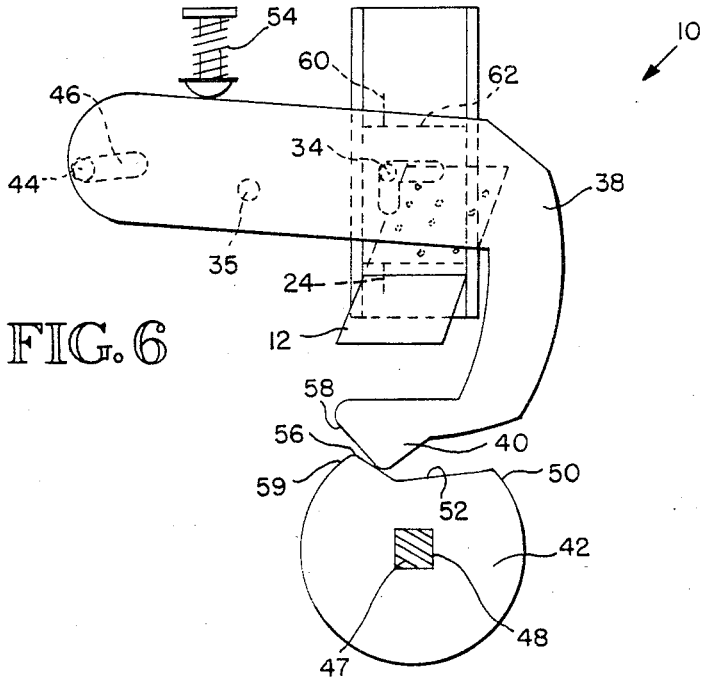
FIG. 6 is a front view of the lock of FIG. 4, showing the lock mechanism in an operating position in which the pins of the plates are engaging the sheet key.
Figure 7:
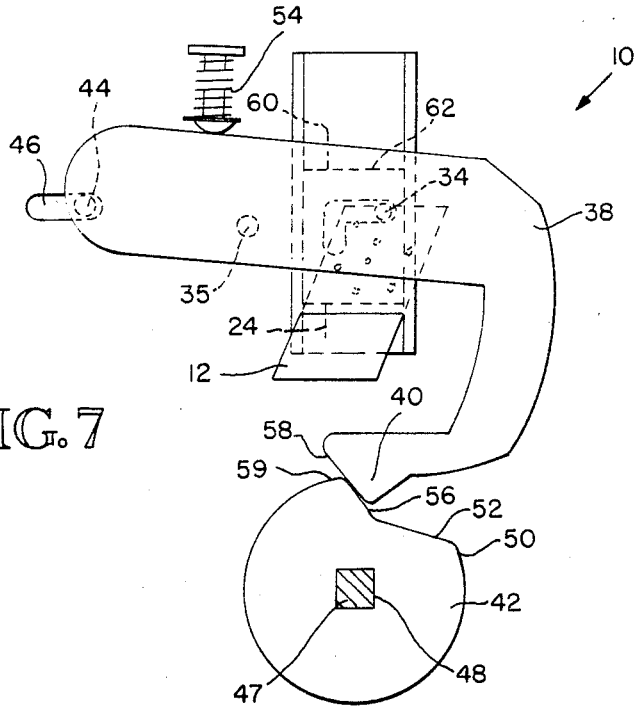
FIG. 7 is a front view of the lock of FIG. 4, showing a cam of the lock mechanism engaging the carrier arm to causing its lateral rightward movement.

In the embodiment of the plates 22 shown in FIGS. 4, 6 and 7, the plates each include a second pin 60 positioned at a selected location along an edge 62 of the plate distant from the key 12 and extending from the plate in a direction away from the key. The second pin 60 is provided to allow selective reversing of the plates 22 within the case 18 to position the second pin for engagement with the key 12, thereby providing each plate with two possible pin positions, depending on its orientation in the case. This reduces the total number of plate styles which must be manufactured by approximately one-half to achieve a desired number of pin locations on the plates. The second pin 60 may also be utilized to carry a coil spring 63 to bias the plates toward the key 12. In the presently preferred embodiment of the invention illustrated in FIGS. 1, 4, 6 and 7, the case 18 is oriented with the plates 22 moving vertically and the pins 24 extending downwardly toward the key 12 positioned therebelow. With such an arrangement, the plates 22 move downwardly along this vertical path by the gravitational force on them when the lug 34 is moved downward by the second cam portion 52 to bring the pins 24 into engagement with the key 12. The springs 63 may be used to facilitate the downward movement of the plates 22 with this vertical orientation, but are not necessary and are provided primarily for situations in which the lock 10 is oriented with the plates other than vertically with the pins 24 extending downwardly.

Figure 9:
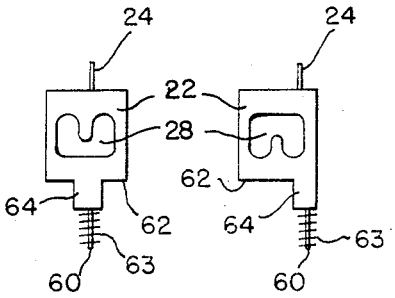
FIG. 9 is a front elevational view of two additional alternative embodiments of the keyed plates, showing a two-opposing-pin arrangement with a spring mounted on one pin.

An alternative embodiment of the plates 22 of the present invention is shown in FIG. 9, with the pin 24 extending upwardly for movement of the plates 22 in a vertical plane, but with the key 12 positioned above the plates. The second pin 60 is fixedly attached to a tab 64 extending from the edge 62 of the plates, and the spring 63 is mounted on the second pin. The tabs 64 of adjacent plates must be laterally offset to avoid the spring 63 of one plate interfering with the spring of the adjacent plate. It is to be understood that the lock 10 of the present invention may be operated with the plates 22 having any orientation. While the spring 63 is shown as a separate coil spring for each plate, other means may be used to resiliently bias the plates 22 toward the key 12.

Figure 8:
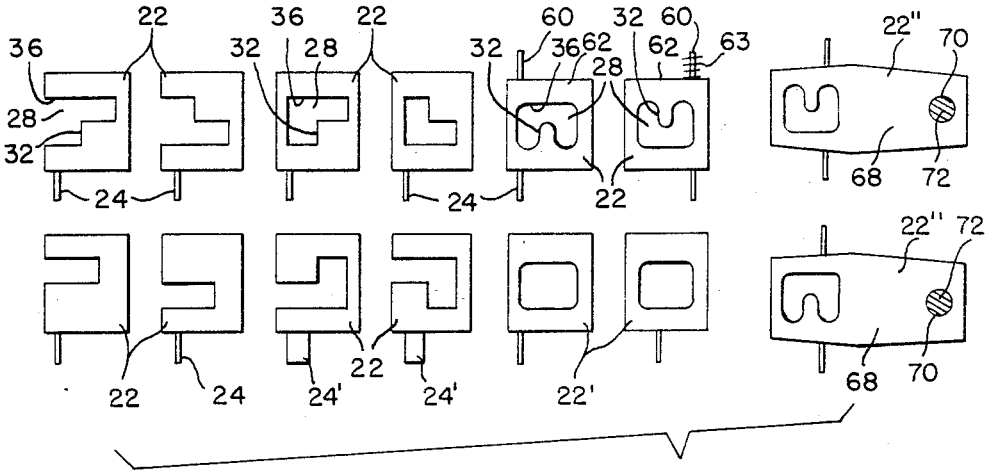
FIG. 8 shows a front elevational view of several embodiments of the keyed plates.

In one preferred embodiment, the plates 22 have upright and inverted "U"-shaped apertures 28, which may be made from the same plate by just attaching the pin 24 to an opposite plate edge, or by using a second pin 60. A number of other possible aperture shapes for the plates 22 are shown in FIG. 8. The two plates 22' shown with rectangular apertures 28 are blanks used with a master pass key. Two of the plates 22 shown in FIG. 8 are provided with a substantially flat, elongated pin 24', in which case the holes 16 in the key 12 may be circular or elongated slots. Also shown in FIG. 8 is an alternative embodiment of the plates 22" in which the plates have a laterally extending portion 68 with a hole 70 therethrough. The plates 22" are designed to be pivotally mounted on a shaft 72 and pivot thereabout during operation of the lock 10. In all other ways, the plates 22" operate as previously described.

As best shown in FIG. 2, the lock 10 may further includes a pair of spaced-apart guide plates 74 and 76 positioned within the case 18 to receive the key 12 therebetween and maintain the key in a flat condition during its insertion through the slot 20 and operation of the lock. With the guide plates 74 and 76, a paper 12 key with less rigidity may be used. The guide plates 74 and 76 have a plurality of longitudinally extending slots 78 to permit uninhibited passage of the pins 24 therethrough for engagement with the key 12.

As previously described, the case 18 has an open top 19 which allows for easy and convenient removal and replacement of the plates 22 when repairing the lock 10 or resetting it to operate on a new predetermined hole pattern.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A lock for use with a nonrotating, flexible sheet key having a body with a plurality of holes therethrough positioned in accordance with a predetermined pattern, comprising:

a case with a slot for insertion of the key therethrough to place the key body in a stationary position within said case;

a plurality of juxtapositioned plates disposed within said case in independently slidable, fact-to-face relative relation to each other for movement along a path generally transverse to the key, each of said plates having a pin fixedly positioned at a selected location along an edge of said plate toward the key and extending therefrom toward the key for engagement therewith, said pins being aligned according to the predetermined hole pattern to have selective ones of said pins enter into the holes and other ones of said pins contact the body upon movement of said plates along said path toward the key for placing each of said plates in a consent position, each of said plates having an aperture sized and positioned for coincidence with said aperture of each other of said plates when moved into their respective consent positions to form an elongated lateral opening, at least one of said plates having a body portion extending transverse to said lateral opening and being positionable to block and limit the length of said lateral opening if said at least one plate is not in said consent position as a result of insertion of a key without the predetermined hole pattern, said plates being positionable away from the key to maintain said pins disengaged from the key for unrestricted insertion of the key into said slot and being movable toward the key for engagement therewith after the key is inserted into said slot; and a lug extending generally transversely through said plate apertures and being laterally movable within said lateral opening formed when said plates are in said consent position to indicate an unlocked condition, lateral movement of said lug being inhibited by said transverse body portion of said at least one plate when not in said consent position to indicate a locked condition.

2. The lock of claim 1 wherein said plates each have a second body portion defining said aperture and located to a side of said aperture away from the key, said lug being engageable with said second body portion of each of said plates and movable in a direction away from the key to hold said pins clear of the key to permit unrestricted insertion of the key into said slot, said lug being further movable in a direction toward the key to permit said pins to engage the key.

3. The lock of claim 2 wherein said lug is attached to a movable member having a cam follower operatively engaging a rotatable cam, said cam having a first portion initially positioning said lug away from the key in engagement with said second body portions to hold said pins clear of the key to permit unrestricted insertion of the key into said slot, said cam having a second portion next moving said lug toward the key upon rotation of said cam to permit said plates to move freely along said path toward the key to bring said pins into engagement therewith, and said cam having a third portion next moving said lug laterally in said lateral opening upon further rotation of said cam when said plates are in said consent position, said third portion permitting continued rotation of said cam without moving said lug laterally when said at least one of said plates is not in said consent position.

4. The lock of claim 3, further including bias means for resiliently biasing said plates toward the key.

5. The lock of claim 4 wherein said bias means includes a spring independently biasing each of said plates.

6. The lock of claim 3 wherein said plates are oriented vertically, with said pins extending downwardly toward the key positionable therebelow, said plates being movable downward along said path toward the key at least partially by the gravitational force on said plates.

7. The lock of claim 3 wherein said cam follower is resiliently biased against said cam.

8. The lock of claim 3 wherein said movable member has a guide pin slidably and rotatably disposed in a laterally extending guide slot, said guide pin being initially positioned toward one end of said guide slot and said guide slot being sized to permit lateral sliding movement of said guide pin therein in response to said third cam portion upon rotation of said cam to move said lug laterally in said lateral opening, said guide pin permitting rotational movement of said movable member thereabout as said cam rotates.

9. The lock of claim 1, further including a pair of spaced-apart guide plates positioned within said case to receive the key therebetween from said slot and maintain the key in a flat condition during insertion and operation of the lock, said guide plates having a plurality of openings therein to permit uninhibited passage of said pins for engaging the key.

10. The lock of claim 1 wherein said plates each have a second pin fixedly positioned at a selected location along an edge of said plate away from the key and extending therefrom, said plates being selectively reversible in said case to position said plates for engagement of said second pins with the key.

11. The lock of claim 1 wherein said case has means for selective removal and replacement of said plates.

12. The lock of claim 1 wherein at least one of said pins is a substantially flat, elongated member.

13. a lock for use with a nonrotating, flexible sheet key having a body with a plurality of holes therethrough positioned in accordance with a predetermined pattern, comprising:

a plurality of plates oriented generally transverse to a key-receiving space wherein the key body can be inserted and retained in a stationary position during operation of the lock, said plates being independently slidable for movement along a path generally transverse to the key, each of said plates having an engagement member fixedly positioned at a selected location along an edge of said plate toward the key and extending therefrom toward the key for engagement therewith, said engagement members being aligned according to the predetermined hole pattern to have selective ones of said engagement members enter into the holes and other ones of said engagement members contact the body upon movement of said plates along said path toward the key for placing each of said plates in a consent position, each of said plates having an aperture sized and positioned for coincidence with said aperture of each other of said plates when moved into their respective consent positions to form a lateral opening, said plates each having a first body portion extending transverse to said lateral opening and being positionable to block and limit the length of said lateral opening if not in said consent position as a result of insertion of a key without the predetermined hole pattern, said plates being positionable away from the key to maintain said engagement members disengaged from the key for unrestricted insertion of the key into said key-receiving space and being movable toward the key for engagement therewith after the key is inserted, said plates each having a second body portion defining said aperture and located to a side of said aperture away from the key; and an arm extending generally transversely through said plate apertures and being laterally movable within said lateral opening formed when said plates are in said consent position to indicate an unlocked condition, lateral movement of said arm being inhibited by said transverse body portions of said plates when not in said consent position to indicate a locked condition, said arm being engageable with said second body portion of each of said plates and movable in a direction away from the key to hold said engagement members clear of the key to permit unrestricted insertion of the key into said key-receiving space, said arm being further movable in a direction toward the key to permit said engagement members to engage the key.

14. The lock of claim 13 wherein said arm is attached to a movable member having a cam follower operatively engaging a rotatable cam, said cam having a first portion initially positioning said arm away from the key in engagement with said second body portions to hold said engagement members clear of the key to permit unrestricted insertion of the key into said key-receiving space, said cam having a second portion next moving said arm toward the key upon rotation of said cam to permit said plates to move freely along said path toward the key to bring said engagement members into engagement therewith, and said cam having a third portion next moving said arm laterally in said lateral opening upon further rotation of said cam when said plates are in said consent position, said third portion permitting continued rotation of said cam without moving said lug laterally when said plates are not in said consent position.

15. The lock of claim 14 wherein said movable member has a guide pin slidably and rotatably disposed in a laterally extending guide slot, said guide pin being initially positioned toward one end of said guide slot and said guide slot being sized to permit lateral sliding movement of said guide pin therein in response to said third cam portion upon rotation of said cam to move said arm laterally in said lateral opening, said guide pin permitting rotational movement of said movable member thereabout as said cam rotates.

16. The lock of claim 13 wherein said engagement members are elongated pins.

17. The lock of claim 16 wherein said pins are substantially flat.

18. The lock of claim 13, further including a pair of spaced-apart guides defining said key-receiving space therebetween and maintaining the key in a flat condition during insertion and operation of the lock, said guide plates having a plurality of openings therein to permit uninhibited passage of said engagement members for engaging the key.

19. The lock of claim 13 wherein said plates each have a second engagement member fixedly positioned at a selected location along an edge of said plate away from the key and extending therefrom, said plates being selectively reversible to position said plates for engagement of said second engagement members with the key.

* * * * *